US007984633B1

(12) United States Patent
Hayes, Jr.

(10) Patent No.: US 7,984,633 B1
(45) Date of Patent: Jul. 26, 2011

(54) ROLL FORMING PRESS

(76) Inventor: James A. Hayes, Jr., Boyce, LA (US)

( * ) Notice: Subject to any disclaimer, the term of this patent is extended or adjusted under 35 U.S.C. 154(b) by 910 days.

(21) Appl. No.: 11/945,862

(22) Filed: Nov. 27, 2007

Related U.S. Application Data

(60) Provisional application No. 60/867,525, filed on Nov. 28, 2006.

(51) Int. Cl.
*B21D 5/08* (2006.01)
*B21B 37/72* (2006.01)

(52) U.S. Cl. ..... 72/178; 72/11.5; 72/176

(58) Field of Classification Search ..... 72/8.8, 72/11.5, 12.5, 176–178, 180–182, 226, 234, 72/250, 365.2
See application file for complete search history.

(56) References Cited

U.S. PATENT DOCUMENTS

2003/0000271 A1* 1/2003 Patty et al. ..... 72/176
2006/0272376 A1* 12/2006 Green et al. ..... 72/181

OTHER PUBLICATIONS

The attached is a brochure illustrating convention roll forming machinery which was in public use in the United States prior to Nov. 28, 2005.

* cited by examiner

*Primary Examiner* — Debra M Sullivan
(74) *Attorney, Agent, or Firm* — Jones, Walker, Waechter, Poitevent, Carrere & Denegre L.L.P.

(57) ABSTRACT

A method of roll forming a metal plate with a desired bend. The method includes a first step of providing a roll press having at least a first and second set of bending rollers; a second step of positioning a lead end of the metal plate past the first set of bending rollers prior to the first set of bending rollers applying a bending force to the metal plate; a third step of applying a bending force with the first set of bending rollers to the metal plate at a point behind the lead end; and a fourth step of moving the lead end of the metal plate past the second set of bending rollers prior to the second set of bending rollers applying a bending force.

15 Claims, 4 Drawing Sheets

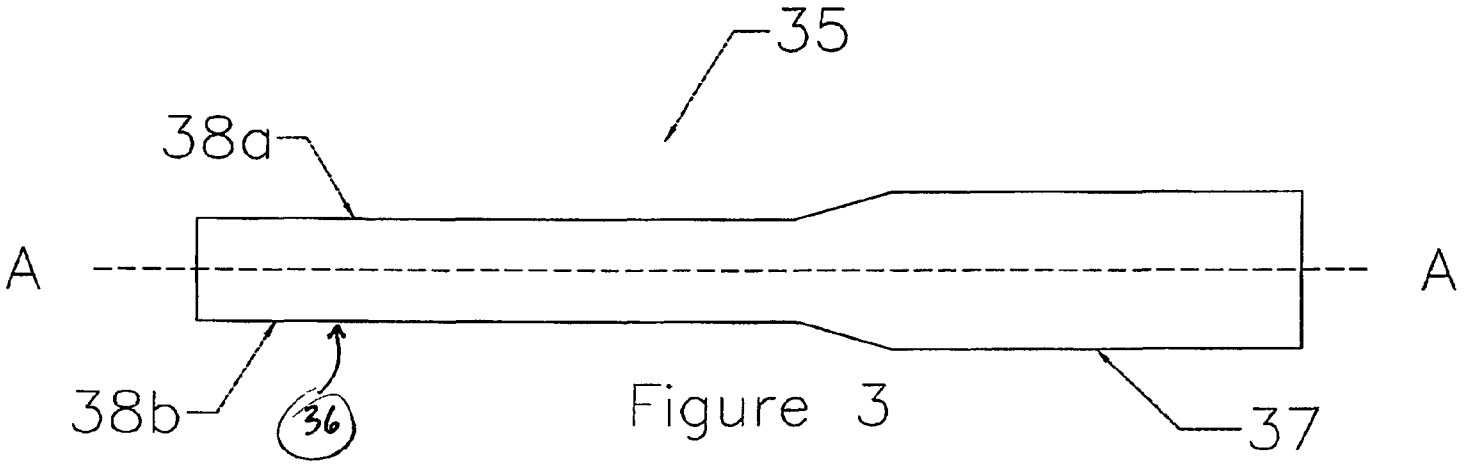
Figure 3
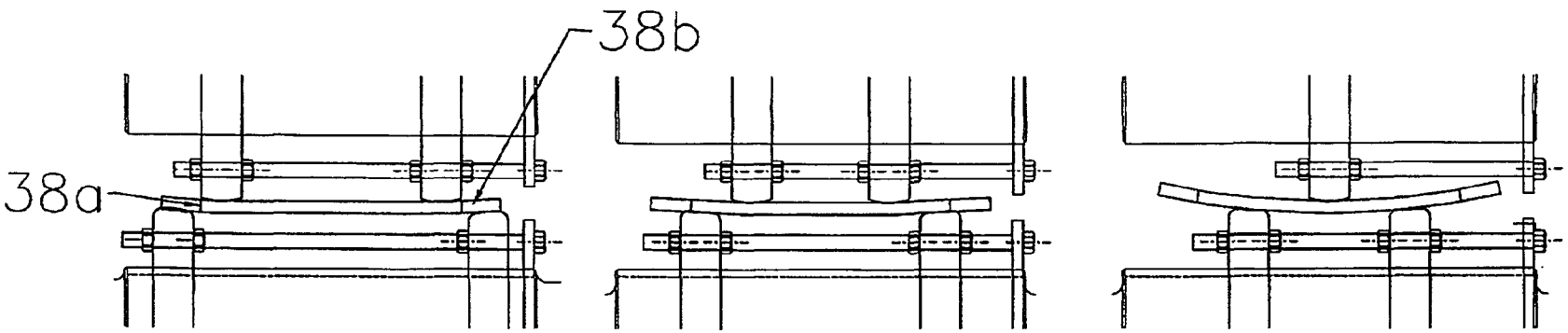
First Bend
Figure 4a
Second Bend
Figure 4b
Third Bend
Figure 4c

ROLL FORMING PRESS

This application claims the benefit under 35 USC §119(e) of U.S. provisional application Ser. No. 60/867,525 filed Nov. 28, 2006, which is incorporated by reference herein in its entirety.

FIELD OF INVENTION

The present invention relates to devices for forming bends in metal. In a particular embodiment, the invention relates to a method and press apparatus for forming bends in metal plates.

BACKGROUND OF INVENTION

There are many conventional devices for shaping comparatively thin (e.g., less than 1/16 of an inch) sheets of metal in particular designs for metal purlins, roof panels, wall panels and many other applications. One such conventional device is a roll forming press such as seen in U.S. Pat. No. 4,903,516, which is incorporated by reference herein in its entirety. Conventional roll forming presses typically have multiple sets of rollers that are pre-positioned prior to the sheet metal blank being fed into the roll forming press. Because of the sudden introduction of extreme bending forces on the lead end of the sheet metal blank, the lead six to twelve inches of the sheet metal blank do not properly take the shape intended to be imparted by the roll forming press, although the remainder of the sheet metal blank will be properly formed. The conventional practice is simply to cut off and discard the distorted lead six to twelve inches. Normally because of the low cost and considerable length of the sheet metal blank, discarding six to twelve inches does not have a significant economic impact.

However, conventional roll forming presses become less useful when dealing with thicker and stronger metal plate, and such conventional presses have not been used to make even simple bends in steel plate with thicknesses on the order of ½ inch or larger. Also, the heavier and more expensive the metal blank, the greater the economic impact of sacrificing the lead six to twelve inches of the metal blank.

One particular application where heavy metal plates need a pre-defined bend or curvature is in the production of reinforcement plates for tanker railcars. Tanker car reinforcement plates are employed to reinforce the connection of the massive tank (which may carry 100 tons of liquid) to the wheel carriages. The reinforcement plates are typically about 23 feet long, 13 to 17 inches wide, and made of high grade ⅝ inch thick steel. The reinforcement plates will have a bend down their centerline (i.e., the side edges bending upward around the long axis of the plate) with the bend having a radius of curvature on the order of 55 to 60 inches. Because of the difficulty in imparting an accurate bend along this axis to such thick steel, the reinforcement plate is normally formed in shorter lengths, the bend imparted to those shorter lengths, and then the shorter lengths welded together to form the final 23 foot reinforcement plate. Naturally, this multi-step manufacturing process adds to the completed reinforcement plate significant costs and potential weak points at the welds.

SUMMARY OF SELECTED EMBODIMENTS

One embodiment of the present invention includes a method of roll forming a metal plate with a desired bend. The method has a first step of providing a roll press having at least a first and second set of bending rollers; a second step of positioning a lead end of the metal plate past the first set of bending rollers prior to the first set of bending rollers applying a bending force to the metal plate; a third step of applying a bending force with the first set of bending rollers to the metal plate at a point behind the lead end; and a fourth step of moving the lead end of the metal plate past the second set of bending rollers prior to the second set of bending rollers applying a bending force.

Another embodiment of the present invention consists of a roll forming press. The roll forming present includes at least a first and second set of bending rollers, where each set of bending rollers has at least traveling upper rollers. The roll form press further has at least one sensor capable of detecting the lead end of a metal plate and a control circuit causing the first set of bending rollers to apply a bending force to the metal plate behind the lead end. Next, the second set of bending rollers apply a bending force to the metal plate past the lead end.

A further embodiment of the present invention consists of a tanker car reinforcement plate formed by the process having the first step of providing a roll press having at least a first and second set of bending rollers; the second step of positioning a lead end of the reinforcement plate past the first set of bending rollers prior to the first set of bending rollers applying a bending force to the reinforcement plate; the third step of applying a bending force with the first set of bending rollers to the metal plate to a point behind the lead end; and the fourth step of moving the lead end of the reinforcement plate past the second set of bending rollers prior to the second set of bending rollers applying a bending force.

A still further embodiment consists of a roll forming press having at least a first and second set of bending rollers and at least one sensor capable of detecting a lead end of a metal plate. The roll forming press further has a control circuit causing the first set of bending rollers to apply a bending force to the metal plate behind the lead end and the second set of bending rollers apply a bending force to the metal plate past the lead end.

BRIEF DESCRIPTION OF THE DRAWINGS

FIG. 3 is an illustration of a tanker car reinforcing plate which could be bent with the roll forming press described herein.

FIGS. 4*a* to 4*c* are detailed views of three bending steps employed by one method described herein.

DETAILED DESCRIPTION OF SELECTED EMBODIMENTS

Figure 1:
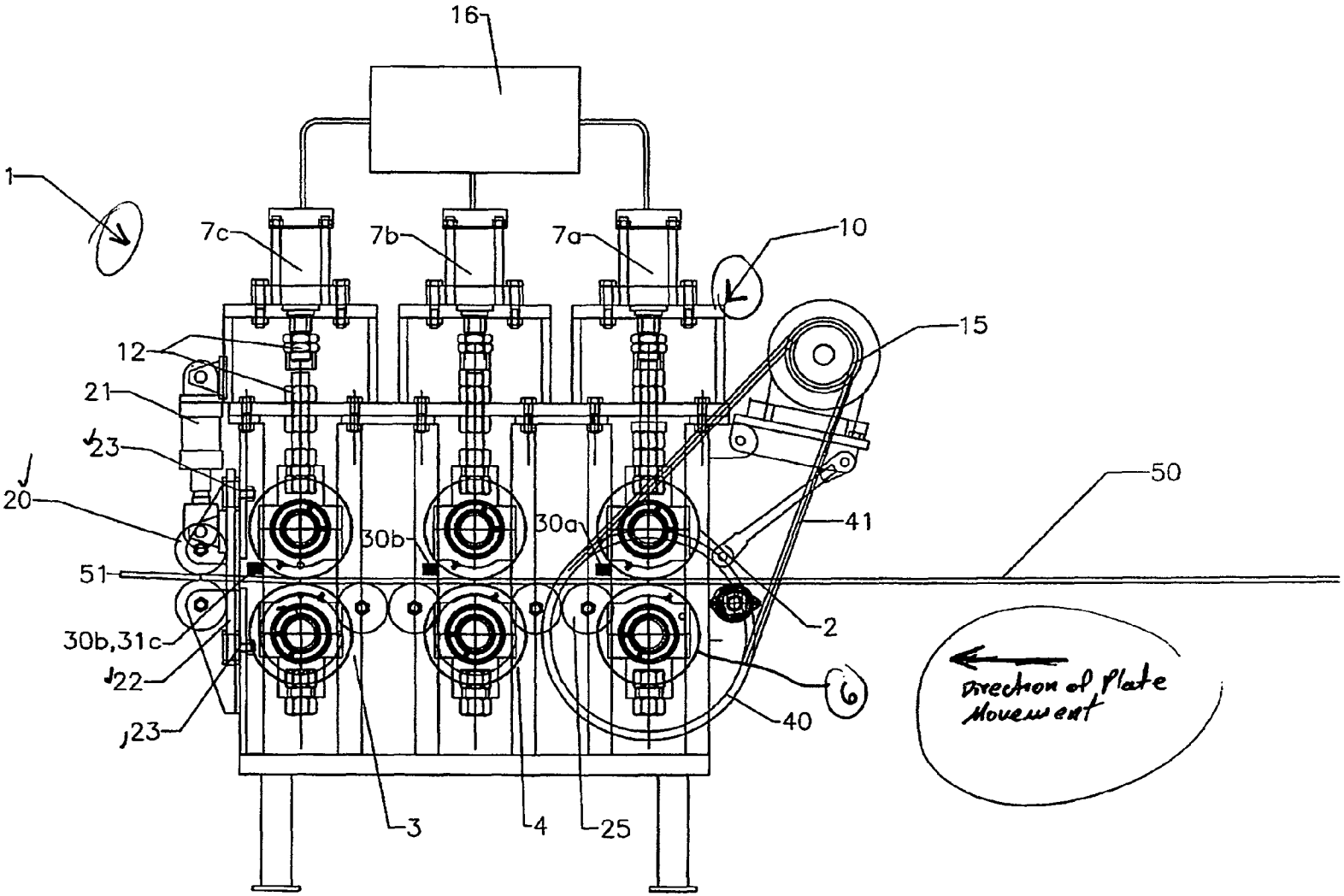
FIG. 1 is a side view of one embodiment of the roll forming press of the present invention.

One embodiment of the present invention is illustrated by the roll forming press 1 seen in FIG. 1. This embodiment of roll forming press 1 will generally comprise a frame 10 on which are positioned three sets of bending rollers (sets 2, 3, and 4 in FIG. 1); i.e., the front or first set of bending rollers 2, the rear or second set of bending rollers 3, and the middle or third set of bending rollers 4. However, while the embodiment of FIG. 1 illustrates three sets of bending rollers, other embodiments of the invention could comprise only two (or possible one) set(s) of bending rollers or more than three (four, five, or more) sets of bending rollers. As used herein, "first" or "second" sets of bending rollers does not necessarily mean the front and rear bending rollers in the roll forming press (especially in embodiments having more than three sets of bending rollers). The number of sets of bending rollers employed will depend on various factors such as the material to be roll formed and the dimensional precision required.

Figure 2C:
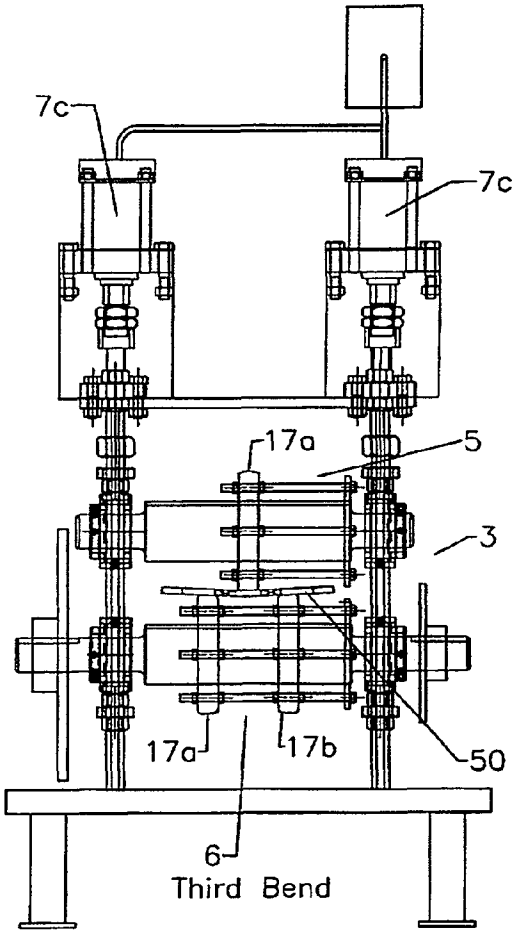
FIGS. 2*a* to 2*c* are end views of the three sets of bending rollers shown in the embodiment of FIG. 1.
Figure 2B:
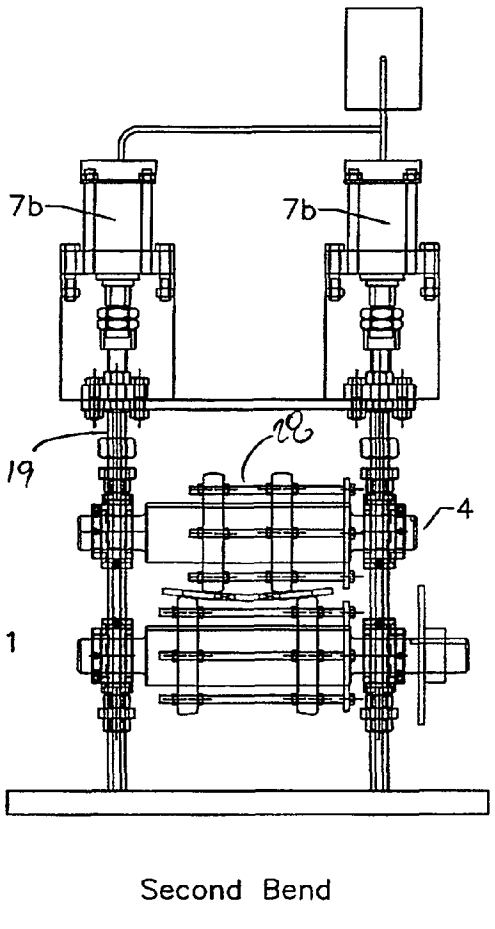
Figure 2A:
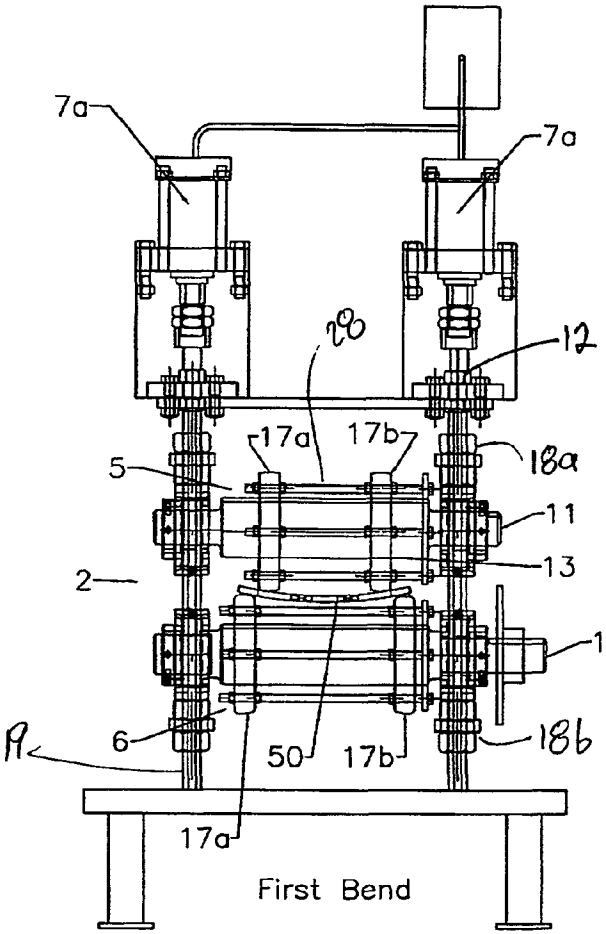

The main components of the various sets of bending rollers are better seen in FIGS. 2*a*-2*c*. FIG. 2*a* illustrates how front set of bending rollers 2 includes traveling or adjustable rollers 5 and stationary rollers 6. It will be understood that the term "adjustable" (or "traveling") and "stationary" refer to the rollers' ability to move (or not move) in the vertical direction. All rollers are capable of rotation; in some instances powered rotation and in other instances free rotation. Traveling rollers 5 are positioned within frame 10 such that hydraulic piston and cylinder assemblies 7 may move traveling rollers 5 upwards and downward, thus exerting a bending force on metal plate 50 resting on the stationary rollers 6 which are fixed in the vertical direction as implied by the term "stationary." However, it will be understood that both rollers 5 and 6 may have their initial vertical position modified by moving the positioning nuts 18 up or down on frame posts 19. Positioning nut 18*b* fixes the height at which stationary rollers 6 rest and positioning nut 18*a* fixes the limit of traveling rollers 5's travel upward. Stop nut 12 limits the downward movement of traveling rollers 5. Although the embodiment of FIG. 2 shows lower rollers 6 as being stationary, alternate embodiments could employ rollers who travel by way of hydraulic cylinders or other means.

Each of rollers 5 and 6 will comprise a roller shaft 11, including enlarged midsection 13. In the embodiment shown, the enlarged midsection 13 is an integral part of the shaft fanned when a larger solid shaft is machined on the ends to a smaller diameter to fit the bearings used in the illustrated embodiment. Rollers 5 and 6 will also include roller surfaces 17 which actually engage metal plate 50. In the embodiment shown, the roller surfaces 17 will be formed of machined alloy steel which is heat treated for hardness. However, many different materials may be employed depending on the particular application.

Bending roller sets 3 and 4 are similar to set 2, excepting that the two roller surfaces 17*a* and 17*b* (on traveling roller 5) in FIG. 2*b* are space more closely together and in FIG. 2*c*, there is only a single roller surface 17*a*. FIG. 2*a* also shows roller tie rods 28. Roller ties rods 28 will be threaded and have nuts on each side of the roller surfaces 17. This will allow the roller surfaces to be adjustably positioned on the rollers.

Returning to FIG. 1, it may be seen how roll form press 1 further includes a gear drive motor 15 and roller chain 41 powering sprocket 40 which in turn powers stationary bending roller 6 on front bending roller set 2. Although hidden from view on the opposite side from that shown in FIG. 1, each of the stationary rollers will have sprockets formed thereon. A roller chain will be positioned around the sprockets such that torque imparted to the first stationary roller 6 will be transferred to the other two stationary rollers in bending roller sets 3 and 4. This roller chain and sprocket arrangement is well known in the art and need not be explained further herein. FIG. 1 also illustrates a series of support rollers 25 which are typically not powered (i.e., rotate freely) and are spaced along the path of reinforcement metal plate 50 to provide support thereto.

Figure 5:
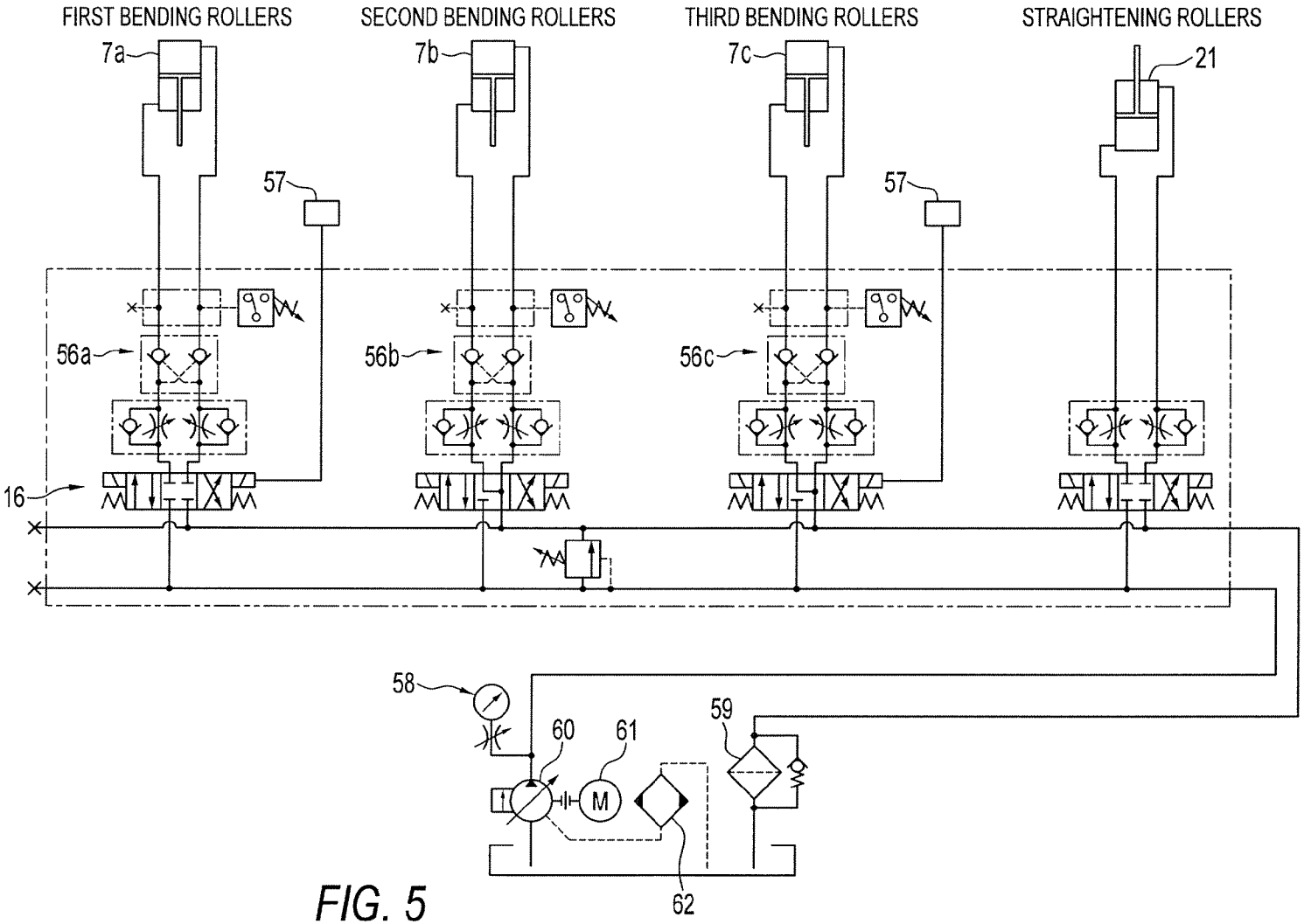
FIG. 5 is a schematic of the control hydraulics used in one embodiment of the present invention.

A control circuit will govern the operation of piston and cylinder assemblies 7*a* to 7*c*. In the embodiment shown, the control circuit will include a set of hydraulic control valves 16. FIG. 5 illustrates one possible version of the control hydraulics which includes three piston and cylinder assemblies 7*a* to 7*c*. Viewing FIG. 2, it can be seen that in this illustrated embodiment, each set of bending rollers will include two piston and cylinder assemblies 7, which will act simultaneously on each end of the roller shafts 11. However, in other embodiments, mechanical linkages may allow the use of only one piston and cylinder assembly or more than two. Hydraulic control valves 16 may function to operate piston and cylinder assemblies 7*a*-7*c* together, independently, or in any combination as will be described in more detail below. In the embodiment shown in FIG. 5, control valves 16 are solenoid control valves, one example of which are model VSD03M3FGB60 manufactured by Continental Hydraulics of Minneapolis, Minn. Naturally, other types of control valves could be employed. Positioned between control valves 16 and piston and cylinder assemblies 7 are flow control valves 56, an example of which are model EF30S manufactured by Deltrol Corporation of Bellwood, Ill., which will regulate the speed at which the piston in assemblies 7 extend and retract. FIG. 5 illustrates proximity sensor 57, which is one type of sensor 30 (see FIG. 1 and description further below) which detects the location of the metal plate 50 and activates control valves 16, causing piston and cylinder assemblies 7 to move bending rollers into engagement with plate 50. The hydraulic schematic of FIG. 7 also illustrates, pressure regulator 58, return filter 59, hydraulic pump 60, motor 61, and case cooler 62 (which is cooled by a fan driven by motor 61). Obviously, FIG. 5 illustrates but one hydraulic layout which could be used to operate roll forming press 1 and many alternative hydraulic arrangements could be employed.

Returning to FIG. 1, the tail end of roll forming press 1 will include the straightening rollers 20. Straightening rollers 20 will be spaced apart the approximate width of metal plate 50 and adjustably fixed to sliding roller support 22. It will be understood that the space between straightening rollers 20 may be adjusted by loosening positioning brackets 23 and adjusting rollers 20 before re-tightening positioning brackets 23. Sliding roller support 22 is in turn slideably connected to frame 10 and may move upward or downward with respect to frame 10. A straightening hydraulic cylinder 21 is positioned between frame 10 and sliding roller support 22. It can be understood that extension or retraction of the piston rod in straightening hydraulic cylinder 21 will move sliding roller support 22 downward or upward with respect to frame 10 and thereby place a downward or upward bending force on metal plate 50 as it exits roll form press 1. In one embodiment of the current invention, an optical sensor such as model E2EVX5C1 by Omron Corporation of Schaumburg, Ill. will detect whether metal plate 50 is exiting roll form press 1 with any undesirable longitudinal bending (i.e., bending around an axis perpendicular to the plane shown in FIG. 1). The sensors will provide an input to circuitry (not shown) which activates straightening hydraulic cylinder 21 to sufficiently reduce or eliminate any undesired longitudinal bending. Alternatively, an operator could simply observe whether metal plate 50 exhibited undesired longitudinal bending and manually activate straightening hydraulic cylinder 21 to correct the longitudinal bending. Naturally, FIG. 1 only shows one embodiment of the straightening cylinder and many other straightening means may be employed. Further, certain embodiments may not require any final straightening apparatus.

One embodiment of the present invention is a method of utilizing a roll forming press 1 such as seen in FIG. 1. This method will include positioning the lead end 51 of metal plate 50 at the front set of bending rollers 2 (FIG. 1 actually shows lead end 51 having already traversed the length of roll forming press 1). However, front set of bending rollers 2 do not immediately place a bending force on metal plate 50. Rather, lead end 51 is allowed to pass front set of bending rollers 2 prior to a bending force being applied. In one method, lead end 51 is allowed to move approximately two inches beyond the point where roller surfaces 17 of front set of bending rollers 2 apply a bending force (i.e., the tangent point of the roller) to metal plate 50. In certain embodiments, it may be desirable to having bending rollers 2 rotating prior to contact with plate 50 at a speed corresponding with plate 50's forward velocity so that the contact of the roller with plate 50 does impair plate 50's forward movement. FIG. 4*a* illustrates metal plate 50 upon application of a bending force by the front set of bending rollers 2. As used herein, "bending force" means sufficient force to cause a lasting strain in metal plate 50; or in other words, to pass the metal's yield point so the metal maintains the bent shape as opposed to rebounding back to its original shape. Thus, depending on the thickness and strength of metal plate 50, roller surfaces 17 may contact metal plate 17 with fairly significant force without necessarily applying a "bending force" thereto.

As front set of bending rollers 2 apply a bending force to metal plate 50, lead end 51 proceeds toward the middle set of bending rollers 4. In one embodiment, the distance between traveling and stationary rollers in the middle set of bending rollers 4 has been pre-set. Thus, middle set of bending rollers 4 immediately apply a bending force to metal plate 50 as soon a lead end 51 passes under the middle set of bending rollers 4 such as seen in FIG. 4*b*. However, in other embodiments, the middle set of bending rollers 4 may apply a bending force to metal plate 50 only after lead end 51 has passed some distance beyond the middle set of bending rollers 4. This selective application of bending force by the middle set of bending rollers 4 may help "fine tune" the degree of bend imparted to metal plate 50. In the example where the middle set of bending rollers 4 are intended to be preset (e.g., no hydraulic control), it is not necessary to position a hydraulic cylinder above this roller.

In the method illustrated, as lead end 51 approaches the rear set of bending rollers 3, this set of bending rollers will allow lead end 51 to pass under it before applying a bending force to metal plate 50. In one embodiment, lead end 51 will pass approximately four inches beyond the rear set of bending rollers 3 before a bending force is applied to metal plate 50 (see FIG. 4*c*). Naturally, in other embodiments the distance may be longer or shorter (e.g., including "0" where the bending force begins being applied at lead end 51). As lead end 51 exits the rear set of bending rollers 3, any undesired longitudinal bending will be detected and straightening rollers 20 will be employed to reduce or eliminate the undesired longitudinal bend as described above. If manually operated, the operator will raise the hydraulically controlled bending rollers when the plate being formed exits the straightening rollers. Alternatively, sensors could detect the exiting of the plate 50 from the roll forming press and raise the bending rollers. Likewise, it is possible that bending rollers could be independently controlled to allow the next plate to enter the roll forming press (be engaged by the first set of bending rollers 2) prior to the previous plate exiting straightening rollers 20.

In the embodiment seen in FIG. 1, sensors 30 will be positioned past the bending roller sets in order to detect the location of the lead end 51 of metal plate 50. In certain embodiments, the sensors 30 will provide signals for activating the control valves 16 when the lead end 51 has travel the desired distance past sensors 30. In FIG. 1, sensors 30 are proximity switches 31 employing optical, magnetic, or other detection means to sense the location of lead end 51. However, in other embodiments, sensors such as mechanically activated limit switches could be employed. Moreover, any type of conventional of future developed sensors could be employed regardless of whether the sensors are based upon an optical, electrical, mechanical, or other detection principle. The exact positioning of sensors 30 may depend on their detection principle and at what point it is desired for bending force to be applied to plate 50. Moreover, still other embodiments of the invention could operate without sensors and simply rely on human operators to manually activate the piston and cylinder assemblies 7 when lead end 51 is in the desired position (e.g., preset markings on metal plate 50 are observed reaching a certain reference point on the roll forming press).

One particular metal plate 50 to which the above described methods could be applied is the tanker railcar reinforcement plate 35 seen in FIG. 3. Reinforcement plate 35 will be approximately 23 feet in length, have an approximately seventeen inch wide front section 37, and an approximately thirteen inch wide rear section 36. Reinforcement plate 35 may be approximately one-half to five-eighths inches thick and formed of high quality steel such as ASTM A572 Grade 50/Type 2 steel. In the case of reinforcement plates 35, the bend radius will be approximately 55 or 60 inches by bending the two sides 38*a* and 38*b* upward around axis A-A seen in FIG. 3. However, other embodiments could provide bend radii of between 35 and 300 inches or any range therebetween (e.g., 35 to 70 inches, 35 to 50 inches, etc.). The methods described above are capable of creating the bend radii with a tolerance of +/−1/16 of an inch, but the invention is not limited to any particular tolerance. Likewise, the particular metal plate 50 can be any length and there is no limit to the length the above apparatus will roll, but in one embodiment the metal plates 50 will range from about 13 to about 23 feet.

The bending force applied to each roller surface 7 when bending the above described reinforcement plate 35 will be on the order of 30 tons. However, this bending force may vary with the dimensions, thickness, and particular material or alloy of metal plate 50. In other embodiments, the force exerted by each roller surface 7 may vary between approximately 10 and 60 tons (or any range therebetween), and in some cases, less than 10 tons or more than 60 tons. It has been found that when using the method of the above embodiments, an accurate bend may be imparted to a single 23 foot metal plate without the necessity of forming the plate in multiple sections which are later welded together. Additionally, the lead end of the metal plate has an accurate bend and it is unnecessary to cutoff any part of the lead end as typically required in the prior art. However, other embodiments of the present invention are not necessarily required to exhibit these particular advantages.

Although certain specific embodiments of the present invention have been described above, the invention is not limited to such embodiments and may include numerous modifications and variations. For example, the piston and cylinder assemblies 7 could be power screws, cams or any other device for delivering sufficient downward force to the rollers. Likewise, while the above described embodiments illustrate the lower bending rollers as stationary, other embodiments could have the lower bending rollers as well as the upper bending rollers being adjustable. Furthermore, PLC's or other control electronics could be used to control rollers, cylinders, etc. to ensure quality control. As an alternative to sensors, the plate position could be determined from an encoder feedback circuit which translates motor (and/or roller) rotation to the position of plate 50 along the roll forming press. All such modifications and variations are intended to come within the scope of the following claims.

I claim:

1. A method of roll forming a metal plate with a desired bend comprising the steps of:

a. providing a roll press having at least a first and second set of bending rollers;

b. positioning a lead end of said metal plate past said first set of bending rollers prior to said first set of bending rollers applying a bending force to said metal plate;

c. applying a bending force with said first set of bending rollers to said metal plate at a point behind said lead end;

d. moving said lead end of said metal plate past said second set of bending rollers prior to said second set of bending rollers applying a bending force.

2. The method according to claim 1, further comprising a third set of bending rollers positioned between said first and second sets of bending rollers.

3. The method according to claim 2, wherein a third set of bending rollers applies a bending force as said lead end passes under said third set of bending rollers.

4. The method according to claim 1, wherein a distance past said lead end at which said second set of bending rollers engages said metal plate is greater than a distance past said lead end at which said first set of bending rollers engages said metal plate.

5. The method according to claim 1, wherein said second set of bending rollers applies a bending force closer to a centerline of said metal plate than does said first set of bending rollers.

6. The method according to claim 1, further comprising the step of providing an adjustable straightening roller which changes position to straighten a longitudinal bend in said metal plate upon exiting said second set of bending rollers.

7. The method according to claim 6, wherein a sensor detects said longitudinal bend and said straightening roller is automatically adjusted.

8. The method according to claim 1, wherein said metal plate has a thickness of at least ½ inch.

9. The method according to claim 8, wherein said metal plates has a length of approximately between approximately 13 and approximately 23 feet.

10. The method according to claim 9, wherein said metal plate is a tanker car reinforcement plate, having an approximately 17 inch front portion and an approximately 13 inch rear portion.

11. The method according to claim 1, wherein said second set of bending rollers has a single traveling roller applying force along an approximate centerline of said metal plate.

12. The method according to claim 4, wherein said first set of bending rollers applies bending force at approximately 2 inches past said lead end and said second set of bending rollers applies bending force at approximately 4 inches past said lead end.

13. The method according to claim 1, wherein a hydraulic cylinder control application of said bending force and a sensor detects a position of said leading end and activates said hydraulic cylinder.

14. The method according to claim 13, wherein said sensor is a proximity sensor or a mechanical limit switch.

15. The method according to claim 1, further comprising a third set of bending rollers positioned between said first and second set of bending rollers, said third set of bending rollers being stationary.

* * * * *